US006170877B1

(12) United States Patent
Zurn

(10) Patent No.: US 6,170,877 B1
(45) Date of Patent: Jan. 9, 2001

(54) PAGE HOLDER

(76) Inventor: Jack H. Zurn, 1030 W. Seagull Dr., Chandler, AZ (US) 85248

( * ) Notice: Under 35 U.S.C. 154(b), the term of this patent shall be extended for 0 days.

(21) Appl. No.: 09/551,998

(22) Filed: Apr. 19, 2000

(51) Int. Cl.[7] ..... B42D 9/00

(52) U.S. Cl. ..... 281/45; 281/42; 281/51; 116/234; 116/236; 116/237; 248/441.1; 248/446; 248/451; D3/29; D19/34; D19/65; D19/75

(58) Field of Search ..... 281/42, 45, 51; 116/234, 236, 237; 248/446, 451, 441.1; D3/29; D19/34, 65, 75

(56) References Cited

U.S. PATENT DOCUMENTS

| | | | | |
|---|---|---|---|---|
| D. 242,703 | * | 12/1976 | Teetor | D19/34 |
| D. 300,228 | | 3/1989 | Eddins . | |
| 1,415,631 | | 5/1922 | Grimm . | |
| 4,474,383 | * | 10/1984 | Kikis | 281/45 |
| 4,487,156 | | 12/1984 | Frost . | |
| 4,726,606 | * | 2/1988 | D'Alessandro | 281/42 |
| 5,165,722 | * | 11/1992 | Wong | 281/42 |
| 5,427,414 | | 6/1995 | Fletcher et al. . | |
| 6,089,609 | * | 7/2000 | Denley | 281/42 |

* cited by examiner

*Primary Examiner*—A. L. Wellington
*Assistant Examiner*—Mark T. Henderson
(74) *Attorney, Agent, or Firm*—Henderson & Strum LLP

(57) ABSTRACT

A page holder adapted to hold opposing pages of a book in an open position while reading. The page holder includes first and second wings meeting at a junction point and disposed at an angle of about 150° with respect to each other. A thumb opening is spaced back from the leading surface of the first and second wings and offset slightly from the junction point toward the first wing. In use, the reader's thumb is inserted into the thumb opening and the junction point is placed between two adjoining pages of an open book near the bottom of the pages. One wing extends over and holds down the page on the right while the other wing holds down the page on the left. One embodiment of the invention is formed of clear plastic material using injection molding, while another embodiment is made of metal wire using wireform manufacturing techniques.

16 Claims, 2 Drawing Sheets

PAGE HOLDER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of reading accessories, and more particularly to a page holding device.

2. Description of Related Art

As can be seen by reference to the following U.S. Pat. Nos. D300,228; 1,415,631; 4,487,156 and 5,427,414 the prior art is replete with myriad and diverse reading accessories.

While all of the aforementioned prior art constructions are more than adequate for the basic purpose and function for which they have been specifically designed, they are uniformly deficient with respect to their failure to provide a simple, efficient, and practical page holder.

As a consequence of the foregoing situation, there has existed a longstanding need for a new and improved page holder and the provision of such a construction is a stated objective of the present invention.

BRIEF SUMMARY OF THE INVENTION

Briefly stated, the present invention provides a page holder adapted to hold opposing pages of a book in an open position while reading. The page holder includes first and second wings meeting at a junction point and disposed at an angle of about 150° with respect to each other. A thumb opening is spaced back from the leading surface of the first and second wings and offset slightly from the junction point toward the first wing. In use, the reader's thumb is inserted into the thumb opening and the junction point is placed between two adjoining pages of an open book near the bottom of the pages. One wing extends over and holds down the page on the right while the other wing holds down the page on the left. One embodiment of the invention is formed of clear plastic material using injection molding, while another embodiment is made of metal wire using wireform manufacturing techniques.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
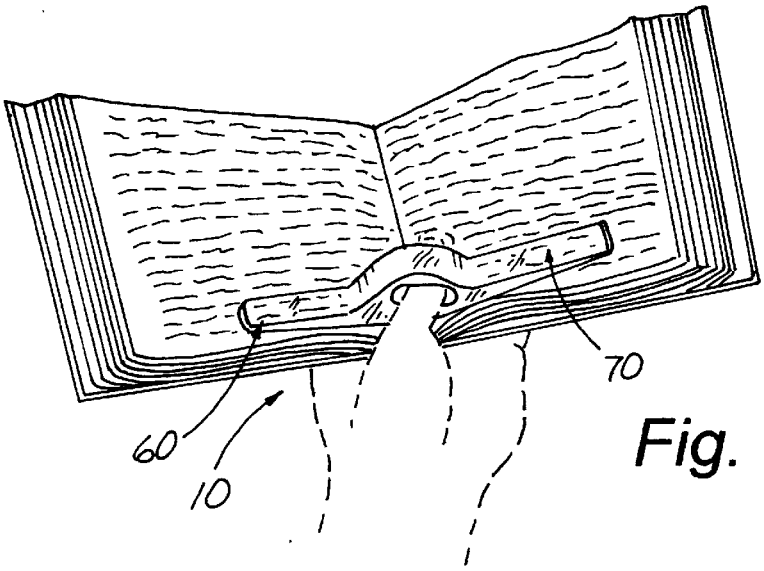
FIG. 1 is a perspective view showing the page holder of the present invention being used by a reader's left hand.
Figure 2:
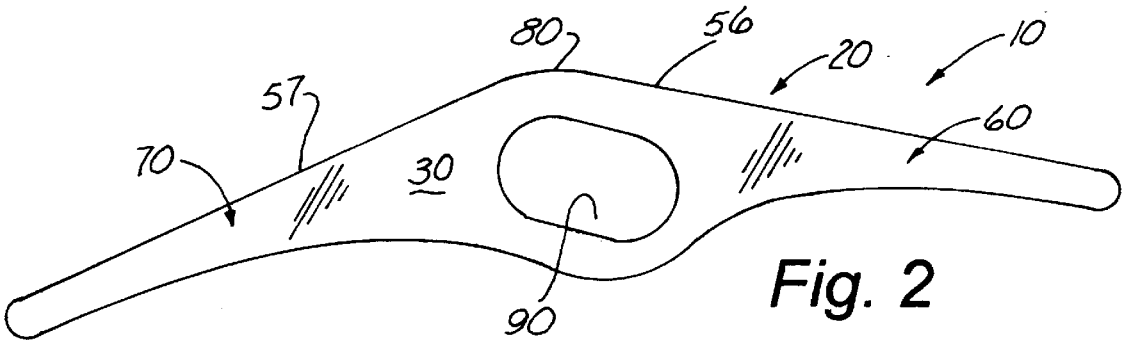
FIG. 2 is an enlarged top plan view of the page holder reversed from the position of FIG. 1 and positioned for use by a reader's right hand.
Figure 3:
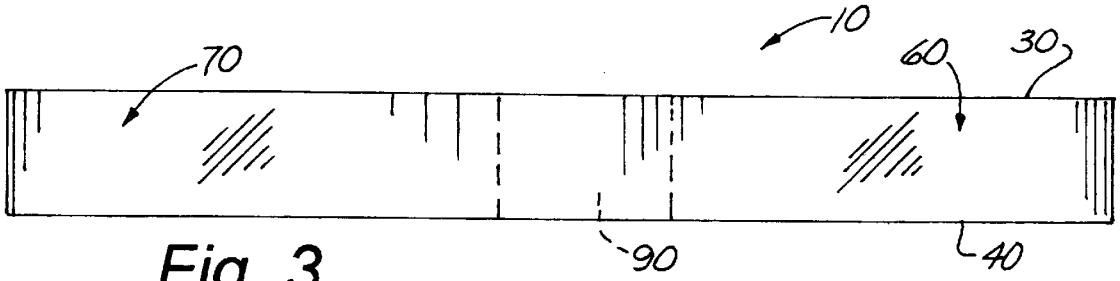
FIG. 3 is a rear elevational view thereof.
Figure 4:
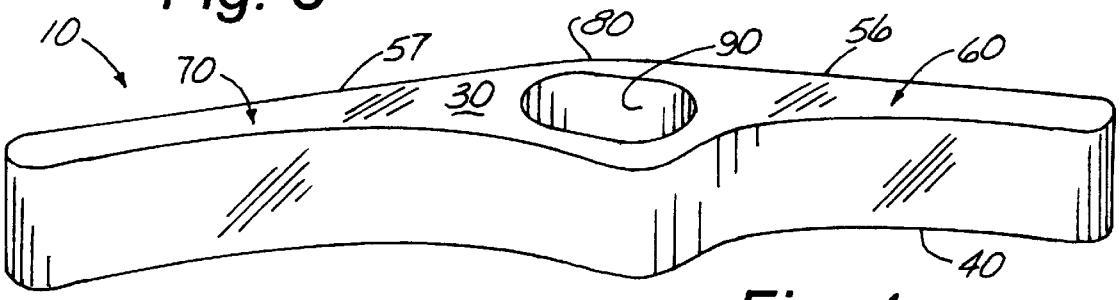
FIG. 4 is a rear perspective view thereof.
Figure 5:
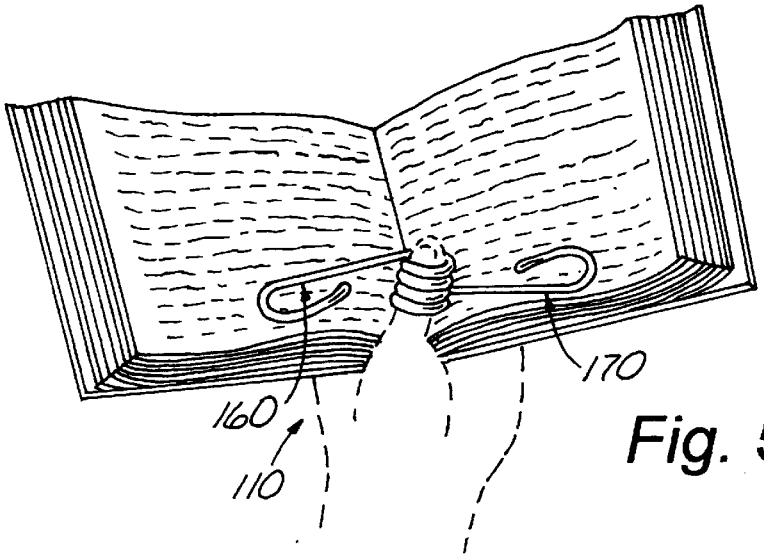
FIG. 5 is a perspective view showing an alternate embodiment of the present invention.
Figure 6:
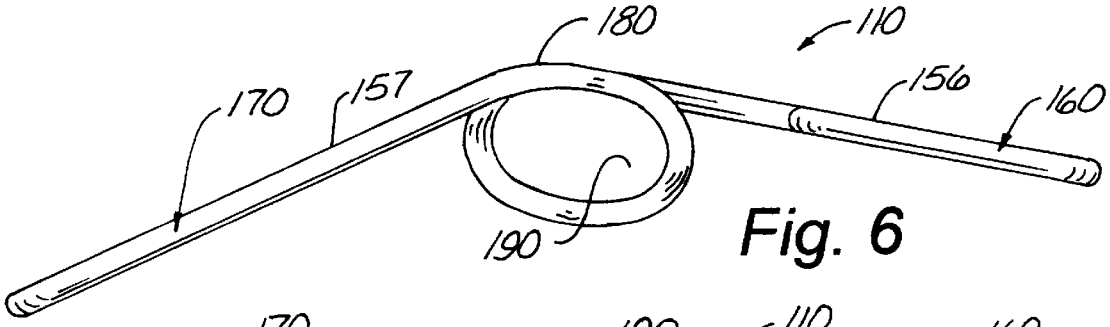
FIG. 6 is an enlarged top plan view of the alternate embodiment reversed from the position of FIG. 5.
Figure 7:
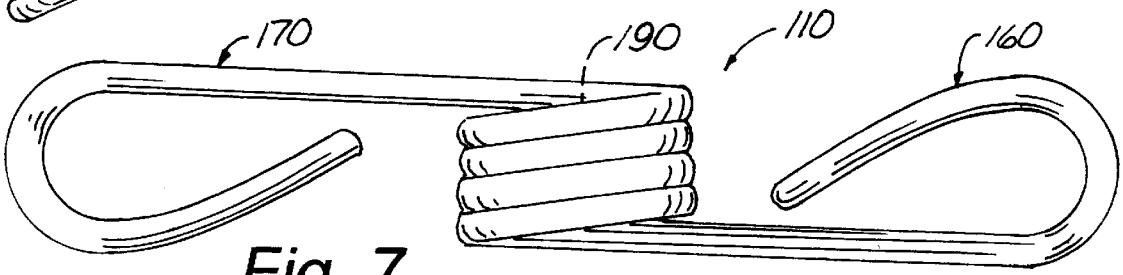
FIG. 7 is a rear elevational view thereof.
Figure 8:
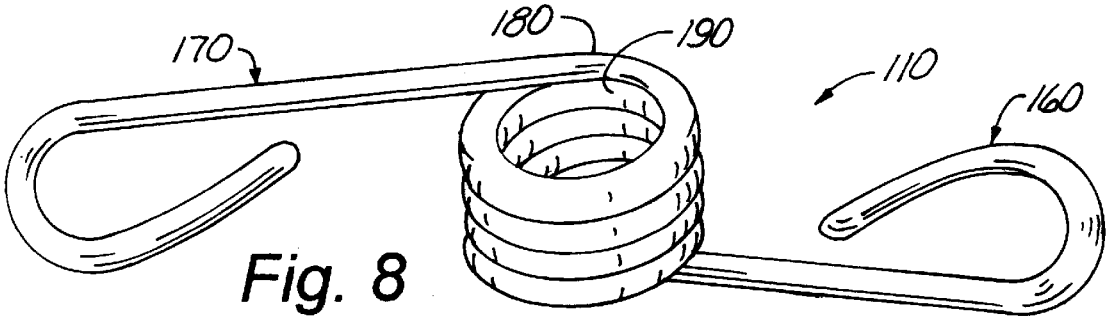
FIG. 8 is a perspective view thereof.

As can be seen by reference to the drawings, and in particularly to FIG. 1, the page holder that forms the basis of the present invention is designated generally by the reference number 10. The page holder 10 is shown being used by a reader's left hand to hold opposing pages of a book in an open position. The page holder 10 is formed of clear plastic material using injection molding procedures. Alternative methods of manufacture and design can be seen in FIGS. 5 through 8 using wireform procedures with polished stainless steel wire materials.

The page holder 10 shown in FIGS. 1–4 comprises a body member 20 having planar parallel disposed top and bottom surfaces 30, 40, and leading surfaces 56 and 67 disposed perpendicular thereto. A first wing 60 with leading surface 56, and a second wing 70 with leading surface 57, meet at a junction point 80 and are disposed at a fixed angle of about 150° with respect to each other. A thumb opening 90 is spaced back from the leading surfaces 56 and 57 and is slightly offset toward the first wing 60.

It is also understood that the page holder 10 may be provided in any number of materials, colors and opacity and can be manufactured using many other manufacturing techniques and processes.

FIGS. 5–8 show an alternate embodiment page holder 110 including a first wing 160 and a second wing 170 connected at a junction port 180. The wings 160, 170 have leading surfaces 156,157 that are disposed at an angle of about 150° with respect to each other. A thumb opening 190 is disposed back from and parallel to the leading surfaces 156, 157 and is offset from the junction point 180 toward the first wing 160. The page holder 110 is made of metal wire using wireform manufacturing techniques.

The page holders 10, 110 fit over the reader's thumb and the first and second wings 60, 70, or 160, 170 and positioned to contact the bottom portion of opposing pages of an open book. The page holder 10, 110 is lightweight and leaves no stress on the reader's hand. Also, the page holder 10, 110 may be used on either hand by simply turning it end-for-end. It is to be understood that the page holder 10, 110 may be provided in any of a number of desired sizes, for example, small, medium and large.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A page holder for holding opposing pages of a book in an open position, the page holder comprising:

a first wing and a second wing connected at a junction point, the first wing having a first leading surface deposed at a fixed angle to a second leading surface of the second wing, the fixed angle ranging from about 140° to about 160°;

a thumb opening disposed parallel to and spaced back from the first and second leading surfaces, the thumb opening being offset from the junction point toward the first wing.

2. The page holder of claim 1 wherein the first wing is disposed at an angle of about 150° to the second wing.

3. The page holder of claim 1 wherein the first and second wings are made of a clear plastic material.

4. The page holder of claim 1 wherein the first and second wings are made of formed metal wire.

5. The page holder of claim 2 wherein the first and second wings are made of a clear plastic material.

6. The page holder of claim 2 wherein the first and second wings are made of formed metal wire.

7. The page holder of claim 5 wherein the first and second wings are formed by injection molding.

8. The page holder of claim 3 wherein the first and second wings are formed by injection molding.

9. The page holder of claim 4 wherein the first and second wings are made using a wireform manufacturing technique.

10. The page holder of claim 9 wherein the first and second wings are made using a wireform manufacturing technique.

11. A page holder for holding opposing pages of a book in an open position, the page holder comprising:

a body member having a planar top surface and a planar bottom surface disposed parallel to the top surface;

a first wing and a second wing connected at a junction point, the first wing having a first leading surface disposed at a fixed angle to a second leading surface of the second wing, the fixed angle ranging from about 140° to about 160°; and a thumb opening formed through the body member between the top and bottom surfaces and being spaced back from the first and second leading surfaces and disposed parallel thereto, the thumb opening being offset from the junction point toward the first wing.

12. The page holder of claim 11 wherein the first wing is disposed at an angle of about 150° to the second wing.

13. The page holder of claim 11 wherein the body member is formed of clear plastic material.

14. The page holder of claim 12 wherein the body member is formed of clear plastic material.

15. The page holder of claim 14 wherein the body member is formed by injection molding.

16. The page holder of claim 13 wherein the body member is formed by injection molding.

* * * * *